US010697739B1

(12) United States Patent
Skipper

(10) Patent No.: US 10,697,739 B1
(45) Date of Patent: Jun. 30, 2020

(54) ELECTRONIC FLASHBANG

(71) Applicant: David Skipper, Anderson, NC (US)

(72) Inventor: David Skipper, Anderson, NC (US)

( * ) Notice: Subject to any disclaimer, the term of this patent is extended or adjusted under 35 U.S.C. 154(b) by 0 days.

(21) Appl. No.: 16/212,319

(22) Filed: Dec. 6, 2018

Related U.S. Application Data

(60) Provisional application No. 62/595,437, filed on Dec. 6, 2017.

(51) Int. Cl.

| | |
|---|---|
| ***F21L 4/00*** | (2006.01) |
| ***F41H 13/00*** | (2006.01) |
| ***F21L 4/08*** | (2006.01) |
| ***F21V 23/04*** | (2006.01) |
| ***H04R 17/00*** | (2006.01) |
| ***H04R 1/02*** | (2006.01) |
| ***F21L 4/02*** | (2006.01) |
| *F21Y 115/10* | (2016.01) |

(52) U.S. Cl.
CPC ..... *F41H 13/0087* (2013.01); *F21L 4/02* (2013.01); *F21L 4/08* (2013.01); *F21V 23/04* (2013.01); *H04R 1/028* (2013.01); *H04R 17/00* (2013.01); *F21Y 2115/10* (2016.08)

(58) Field of Classification Search
CPC ..... F41H 13/0083; F21L 4/08; F21L 4/02; F21V 23/04; H04R 1/028; H04R 17/00; F21Y 2115/10
USPC ..... 362/184
See application file for complete search history.

(56) References Cited

U.S. PATENT DOCUMENTS

| | | | | | |
|---|---|---|---|---|---|
| 5,351,623 | A * | 10/1994 | Kissel | F42B 8/26 | 102/275.6 |
| 6,142,894 | A * | 11/2000 | Lee | A63B 43/00 | 446/397 |
| 7,191,708 | B2 * | 3/2007 | Ouliarin | F42B 8/18 | 102/355 |
| 7,649,323 | B1 * | 1/2010 | Kuhlmann | H05B 33/0803 | 315/200 A |
| 2005/0228231 | A1 * | 10/2005 | MacKinnon | A61B 1/05 | 600/180 |
| 2008/0216699 | A1 * | 9/2008 | McAleer | F42B 12/36 | 102/367 |
| 2009/0154726 | A1 * | 6/2009 | Taenzer | G10L 25/78 | 381/94.1 |
| 2009/0262307 | A1 * | 10/2009 | Bartlett | G03B 21/208 | 353/31 |
| 2010/0072895 | A1 * | 3/2010 | Glynn | F41H 13/0081 | 315/76 |

(Continued)

*Primary Examiner* — Ali Alavi
(74) *Attorney, Agent, or Firm* — Wilson Daniel Swayze, Jr.

(57) ABSTRACT

The present invention provides an electronic flashbang device including solid state electronics to produce and control sound and light emissions. The device comprises a housing disposed with at least twelve high intensity LEDs at an exterior surface. The housing further includes at least two high decibel sirens. The device further includes a rechargeable batteries to feed power to the LEDs and sirens. A safety switch is incorporated at the outer surface of the housing to activate the electronic flashbang device. On operation of the device, the LEDs are configured to generate brighter light emission and the sirens are configured to emit an intensely loud noise pulse, thereby disables the target for a short period of time allowing safer entry without any fire, soft tissue injury to the target, user or infrastructure.

11 Claims, 10 Drawing Sheets

(56) References Cited

U.S. PATENT DOCUMENTS

| | | | | |
|---|---|---|---|---|
| 2014/0091939 | A1* | 4/2014 | Won | G10K 9/22<br>340/693.6 |
| 2017/0164079 | A1* | 6/2017 | Xu | H04R 1/025 |
| 2018/0224111 | A1* | 8/2018 | Emerson | F21V 29/58 |

* cited by examiner

ELECTRONIC FLASHBANG

BACKGROUND OF THE INVENTION

A. Technical Field

The present invention generally relates to flashbang device. More specifically, the present invention relates to an electronic flashbang device that utilizes solid state electronics to create a blinding flash and an extremely loud sound, thereby maintains the safety of the user, targets and infrastructure.

B. Description of Related Art

Tactical stun grenade, popularly known as flashbang is a vital device in the inventory of police, SWAT, and military tactical teams worldwide. The flashbang is a non-lethal device, designed to produce a blinding flash of light and a high-decibel sound. Hence, the flashbang has seen service in most areas of law enforcement and military groups, where non-lethal force is required. The flashbang devices are fabricated using a metal/oxidant mix of chemicals. These are ignited by a fuse and explodes to produce a large magnitude flash of light and very loud burst of sound. The light overpowers the photoreceptor cells in the eye, making vision impossible for approximately five seconds, after which the vision slowly returns. An afterimage will also be visible for minutes, impairing the person's ability to aim accurately. The explosion also creates a very loud noise, which causes a temporary loss of hearing and disturbs the fluid in the inner ear causing a loss of equilibrium.

The conventional flashbang uses pyrotechnic material in its construction, which creates a concussive blast causing permanent injuries and even death in some cases. The pyrotechnic material used can cause fire by igniting flammable materials. Persons in closer proximity to the activation of the flashbang can suffer serious burns, injury. The traditional flashbang is an explosive device, and all the danger associated with explosives will be present when it is in use. The flashbang is also a one-time use device and requires replacement each time a unit is deployed in service. Hence, the explosive pyrotechnic device should be replaced with a safer and actual non-lethal product that can be reused.

Therefore, there is a need for an electronic flashbang device to create a blinding flash and an extremely loud sound while maintaining the safety of the user, targets and infrastructure.

SUMMARY OF THE INVENTION

The present invention relates to an electronic flashbang device to create a blinding flash and an extremely loud sound while maintaining the safety of the user, targets and infrastructure.

In an embodiment, the electronic flashbang device utilizes solid state electronics to control sound and light emissions to produce similar or better effects than the conventional flashbang grenade. The flashbang device comprises a housing containing piezo sirens and LEDs. In an embodiment, the housing comprises at least two piezo sirens and at least twelve LEDs. In an embodiment, the LEDs are positioned at an outer surface of the housing. The flashbang device is powered by a battery assembly to produce a very loud noise pulse and exceptionally bright flash, thereby prevents any physical harm to humans or other properties such as buildings or interior furnishings. In one embodiment, the battery assembly comprises rechargeable batteries. In one embodiment, the flashbang device is configured to operate repeatedly by utilizing the battery assembly.

In an embodiment, the LEDs are driven by 10 W for a short pulse of time to generate light emission. In one embodiment, the at least 12 LEDs together produces 7,800 lumens to generate brighter light emission. In one embodiment, the at least two 120 dB siren emits an intensely loud, disorienting, 3,000 Hz noise pulse when the device is energized. The flash of light and disorienting noise disables the target for a short period of time allowing safer entry without any fire, soft tissue injury occurrences, lethal effects or permanent injury to the people or infrastructure in vicinity of the explosion.

Further, the present invention comprises a safety switch disposed on the housing for activation of the electronic flashbang device. The safety switch comprises the safety guard. In one embodiment, the safety guard is a spring loaded, molded cover that stays down until lifted by the user. The safety switch comprises a metal base that allows the switch to conform slightly to the protective housing curve. In one embodiment, the housing comprises a spherical-shaped body, providing a spherical structure to the flashbang device. In one embodiment, the housing comprises a pill-shaped body, providing a pill structure to the flashbang device.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF EMBODIMENTS

A description of embodiments of the present invention will now be given with reference to the Figures. It is expected that the present invention may be embodied in other specific forms without departing from its spirit or essential characteristics. The described embodiments are to be considered in all respects only as illustrative and not restrictive.

Figure 1:
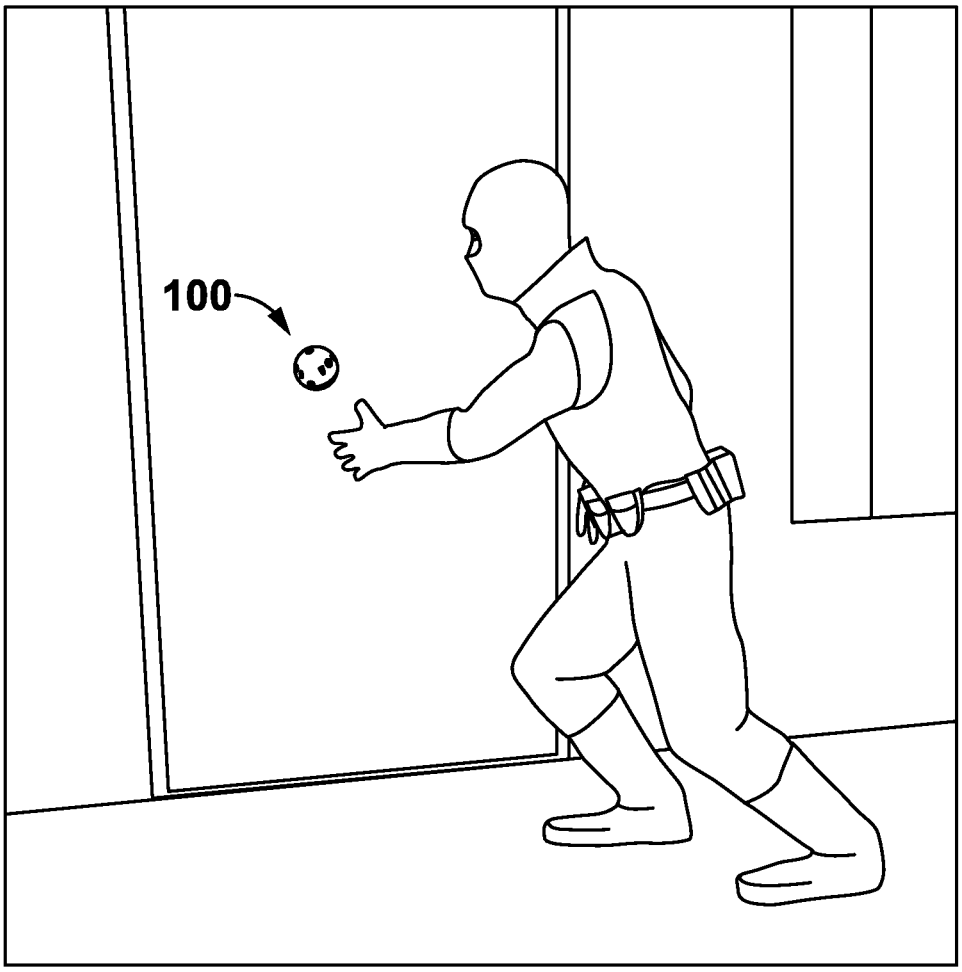
FIG. 1 shows a user utilizing an electronic flashbang device in an embodiment of the present invention.
Figure 2:
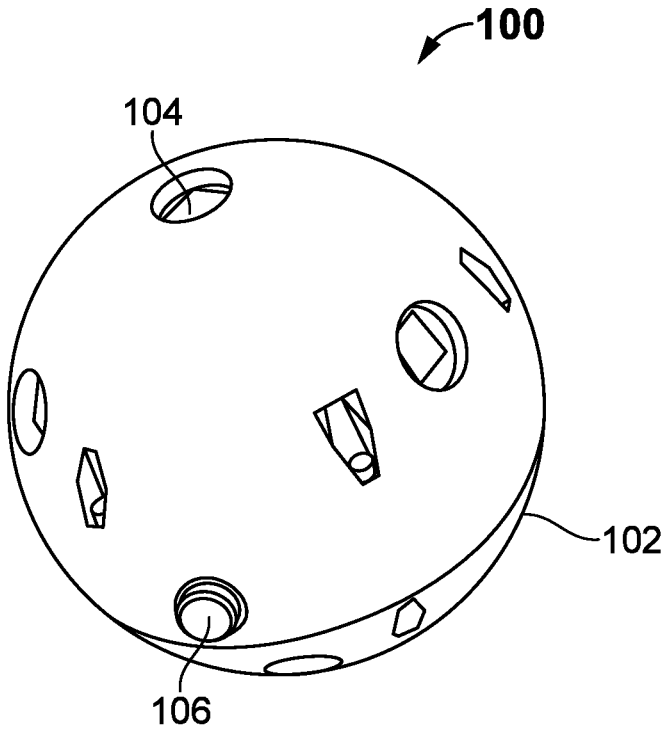
FIG. 2 shows the electronic flashbang having a spherical-shaped housing in an embodiment of the present invention.

Referring to FIGS. 1 & 2, an electronic flashbang device 100 utilizes solid state electronics to control sound and light emissions to produce similar or better effects than the conventional flashbang grenade. The flashbang device 100 comprises a housing 102 containing piezo sirens 122 (shown in FIG. 10) and LEDs 104. In an embodiment, the housing 102 comprises at least two piezo sirens 122 and at least twelve LEDs 104. In an embodiment, the LEDs 104 are positioned at an outer surface of the housing 102. The flashbang device 100 is powered by a battery assembly to produce a very loud noise pulse and exceptionally bright flash, thereby prevents any physical harm to humans or other properties such as buildings or interior furnishings. In one embodiment, the flashbang device 100 is configured to operate repeatedly by utilizing the battery assembly. In one embodiment, the housing 102 comprises a spherical-shaped body, providing a spherical structure to the flashbang device 100, as shown in FIG. 1.

Figure 3:
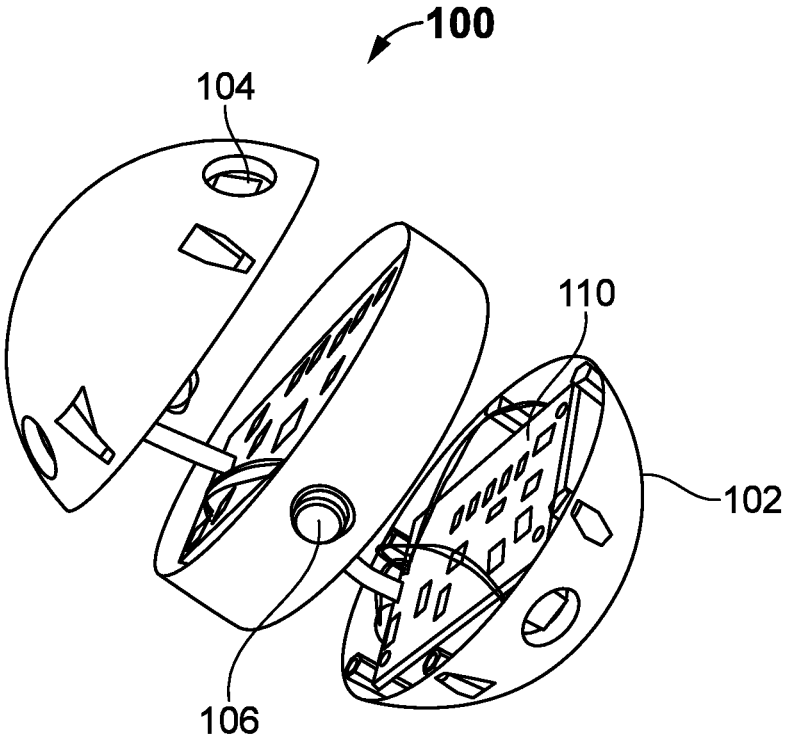
FIG. 3 shows solid state electronic components of the electronic flashbang device in an embodiment of the present invention.

Referring to FIG. 3, the flashbang device 100 comprises solid state electronic components 110 for providing an explosion of light and sound and to maintain the safety of the user, targets and infrastructure. In an embodiment, the at least two piezo sirens 122 configured to generate 120 dB noise pulse. In an embodiment, the LEDs 104 are driven by 10 W for a short pulse of time to generate light emission. In one embodiment, the at least 12 LEDs 104 together produces 7,800 lumens to generate brighter light emission. Further, the present invention comprises a safety switch 106 disposed on the housing 102 for activation of the electronic flashbang device 100. In one embodiment, the present invention comprises spring loaded safety switch 106 to activate the electronic flashbang device 100.

Figure 4:
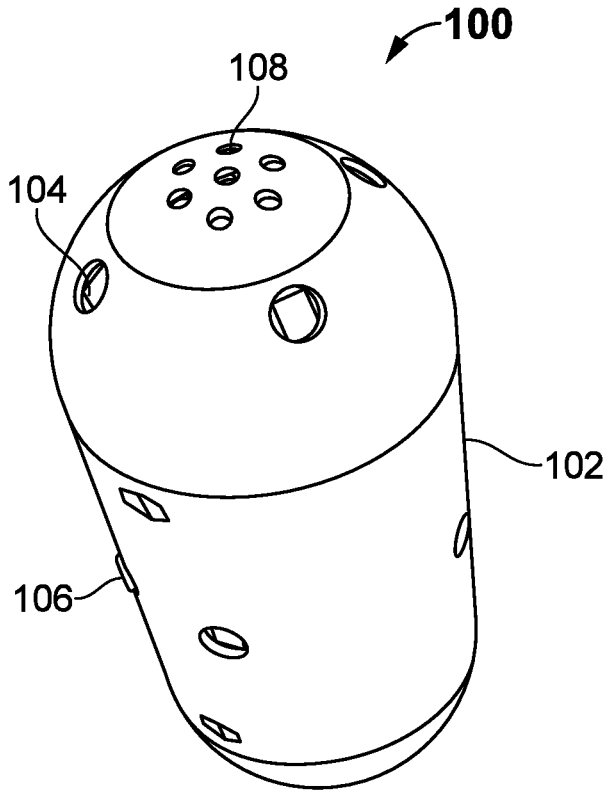
FIG. 4 shows a top perspective view of the electronic flashbang device having a pill-shaped housing in an embodiment of the present invention.
Figure 5:
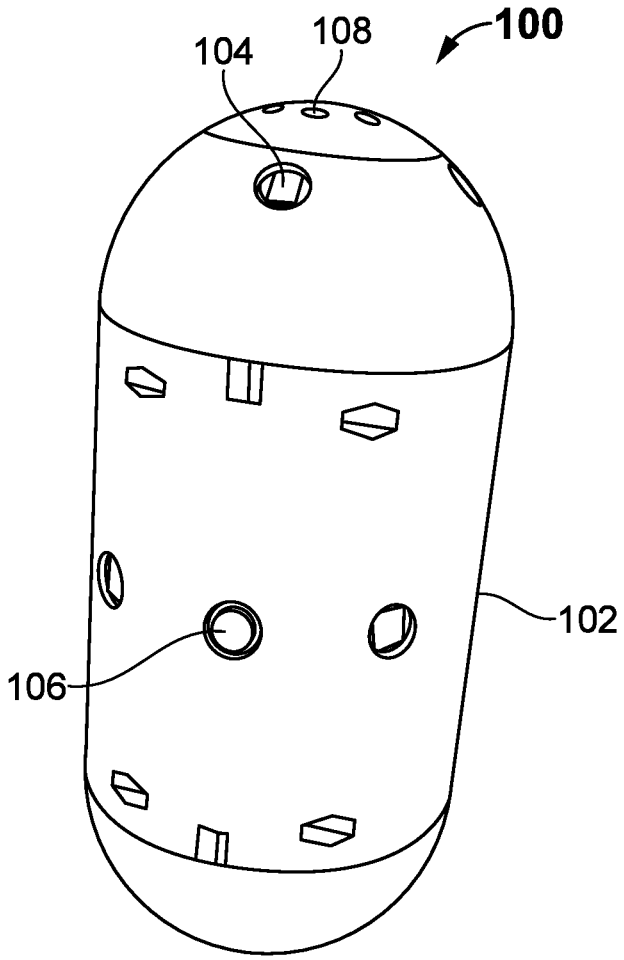
FIG. 5 illustrates a safety switch of an electronic flashbang device having the pill shaped housing in an embodiment of the present invention.
Figure 6:
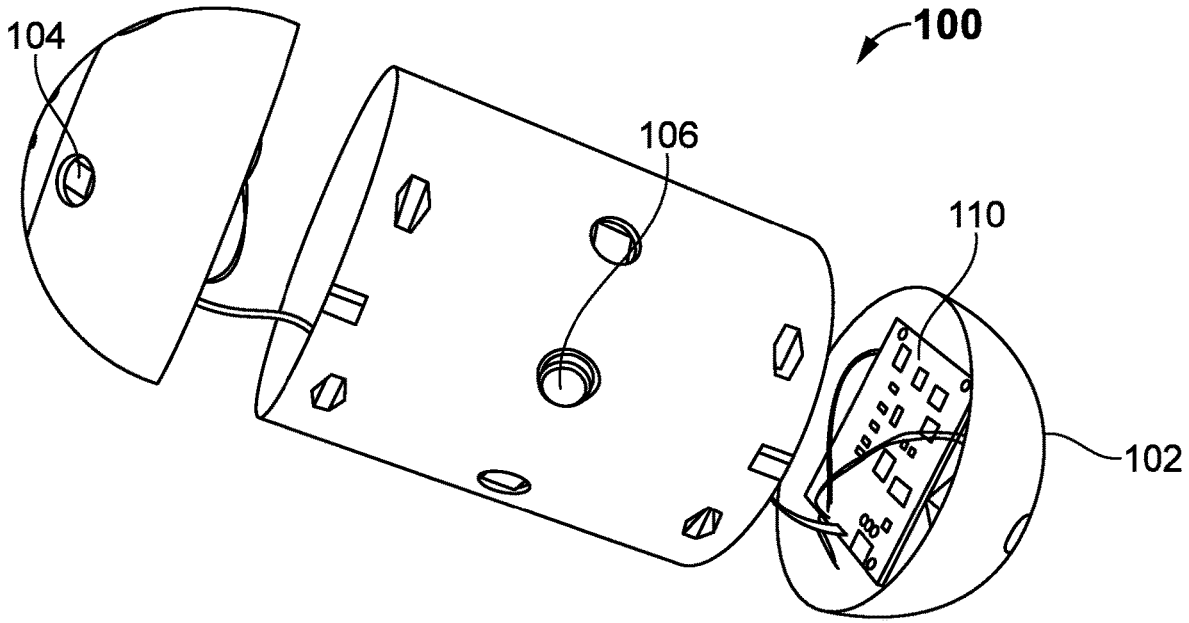
FIG. 6 illustrates solid state electronic components of the electronic flashbang device in an embodiment of the present invention.

FIG. 4 shows a top perspective view of the electronic flashbang device 100 having a housing 102 of pill-shape in an embodiment of the present invention. The housing 102 comprising the pill shaped body provides a pill structure to the electronic flashbang device 100. In one embodiment, the at least two sirens 122 are position at each end of the housing 102. In FIG. 5, the at least twelve LEDs 104 and the safety switch 106 disposed at an outer surface of the housing 102, in one embodiment of the present invention. FIG. 6 shows the solid state electronic components 110 disposed within the housing 102 of the electronic flashbang device 100. In one embodiment, the battery assembly is disposed at a center section of the housing 102.

Figure 7:
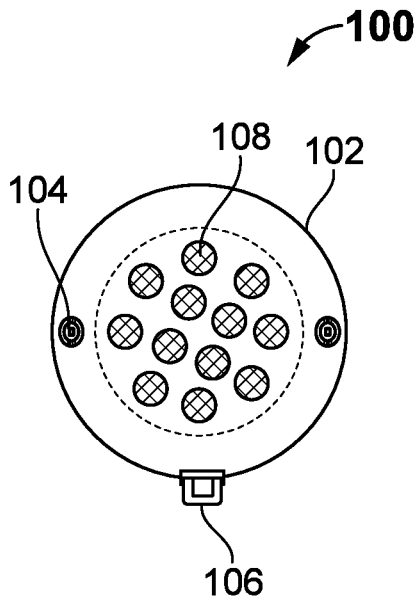
FIG. 7 shows a side view of the electronic flashbang device having the spherical-shaped housing in an embodiment of the present invention.

In FIG. 7, the housing 102 is of spherical structure disposed with LEDs 104 and a plurality of holes 108 to allow pass through of sound produced by the siren 122. The LEDs 104 are blinked with low current at a very short pulses of current. The noise causes a temporary loss of hearing & redistributes the fluid in the ear, causing a loss of balance. The safety switch 106 is a momentary device that engages a microcontroller 126 to activate the device 100 two seconds after engagement, shown in FIG. 10. The safety switch 106 comprises a safety guard 116 to prevent the use of the switch 106 until the user is ready to engage the device 100. The safety guard 116 reduces the opportunity for inadvertent operation.

Figure 8:
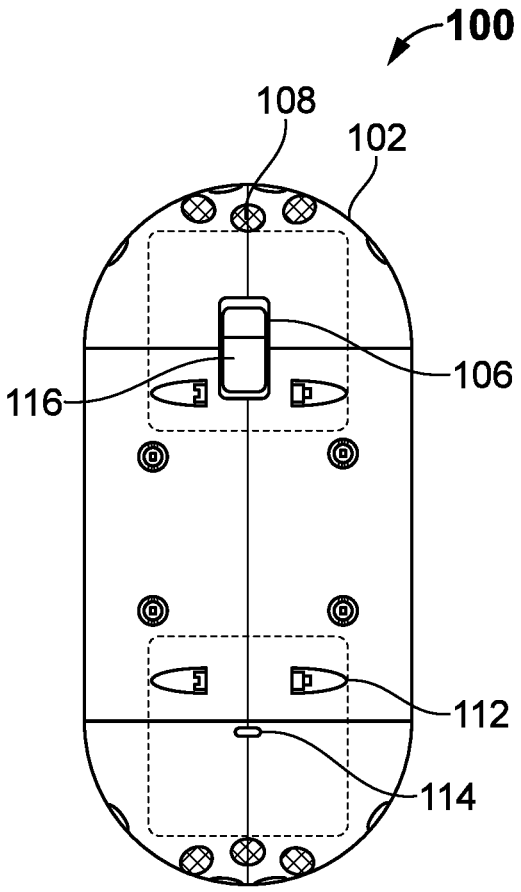
FIG. 8 shows a side view of the electronic flashbang device having the pill-shaped housing in an embodiment of the present invention.

In FIG. 8, the housing 102 is of pill shape, disposed with LEDs 104 on the outer surface of housing 102. The at least 12 LEDs 104 emits a blinding flash of light to blind the people at the vicinity of device 100 for approximately 5 seconds. The at least two 120 dB siren 122 emits an intensely loud, disorienting, 3,000 Hz noise pulse when the device 100 is energized. The flash of light and disorienting noise disables the target for a short period of time allowing safer entry without any fire, soft tissue injury occurrences, lethal effects or permanent injury to the people or infrastructure in vicinity. In one embodiment, the device 100 is rechargeable and could be re-used, where the conventional percussive flashbang could only be used once. In one embodiment, the housing 102 is made of reinforced plastic case. In another embodiment, the reinforced plastic housing 102 is screwed together with stainless steel fasteners 112. Further, the housing 102 is drop and shock resistant. The device 100 further comprises a small Lightning port 114 that allows easy recharge with a supplied 120V to 12V adapter, cord, and connector. In one embodiment, the device 100 could be deployed same as the conventional flashbang and the device 100 provides same results without any damage to humans or infrastructure.

Figure 9A:
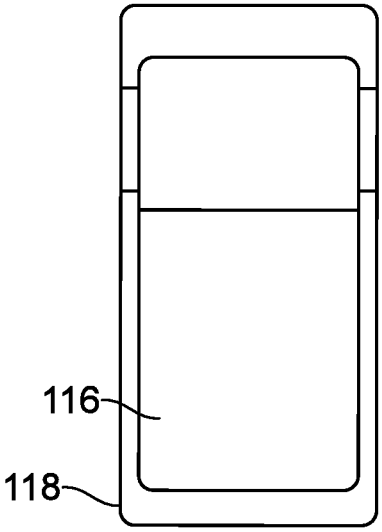
FIG. 9A shows the safety switch of the electronic flashbang device in an embodiment of the present invention.

Referring to FIG. 9A, the safety switch 106 comprises the safety guard 116. In one embodiment, the safety guard 116 is a spring loaded, molded cover that stays down until lifted by the user. The safety switch 106 comprises a metal base 118 that allows the switch 106 to conform slightly to the protective housing 102 curve. Further, the safety switch 106 is disposed on the outer surface of the housing 102, such that the safety switch 106 projects from the outer surface of the housing 102. Thereby, the safety switch 106 reduces the ability of the device 100 to roll after the device 100 is thrown into position. Further, reduces the chances of rolling under a table, couch or chair.

Figure 9B:
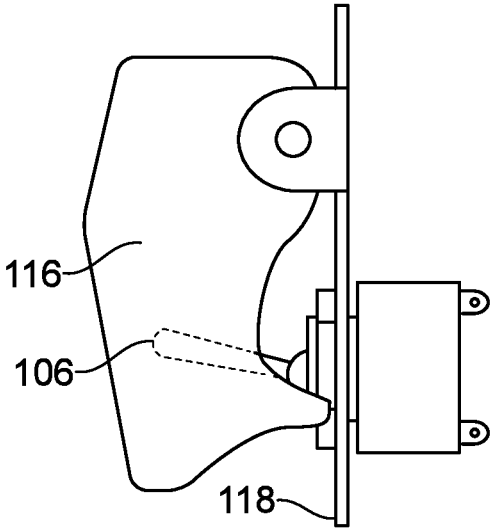
FIG. 9B shows a side view of the safety switch of the electronic flashbang device in an embodiment of the present invention.

Referring to FIG. 9B, the safety switch 106 is a toggle type switch, which need to be moved from the OFF to ON position by force. In one embodiment, the safety guard 116 could be supplied with any vibrant color. In one embodiment, the housing 102 could be supplied with any vibrant color.

In one embodiment, the housing 102 is made of plastic material. In one embodiment, the housing 102 is injection molded in four sections utilizing fiberglass reinforced polypropylene plastic. The housing 102 is configured to clamp onto an end caps and utilizes stainless steel fasteners 112 to firmly secure the housing 102 into one solid device 100. In one embodiment, the device 100 is very rugged and the empty housing 102 is configured to survive a drop shock of 25' without degradation, regardless of orientation. In one embodiment, openings provided in the housing are sized and shaped to protect the internal components during use, yet allow maximum transmission of the sound and light. In one embodiment, the housing 102 could be sized to any shape.

In one embodiment, the shape of the housing 102 is at least one of a ball, a tri-lobe, and pill.

Figure 10:
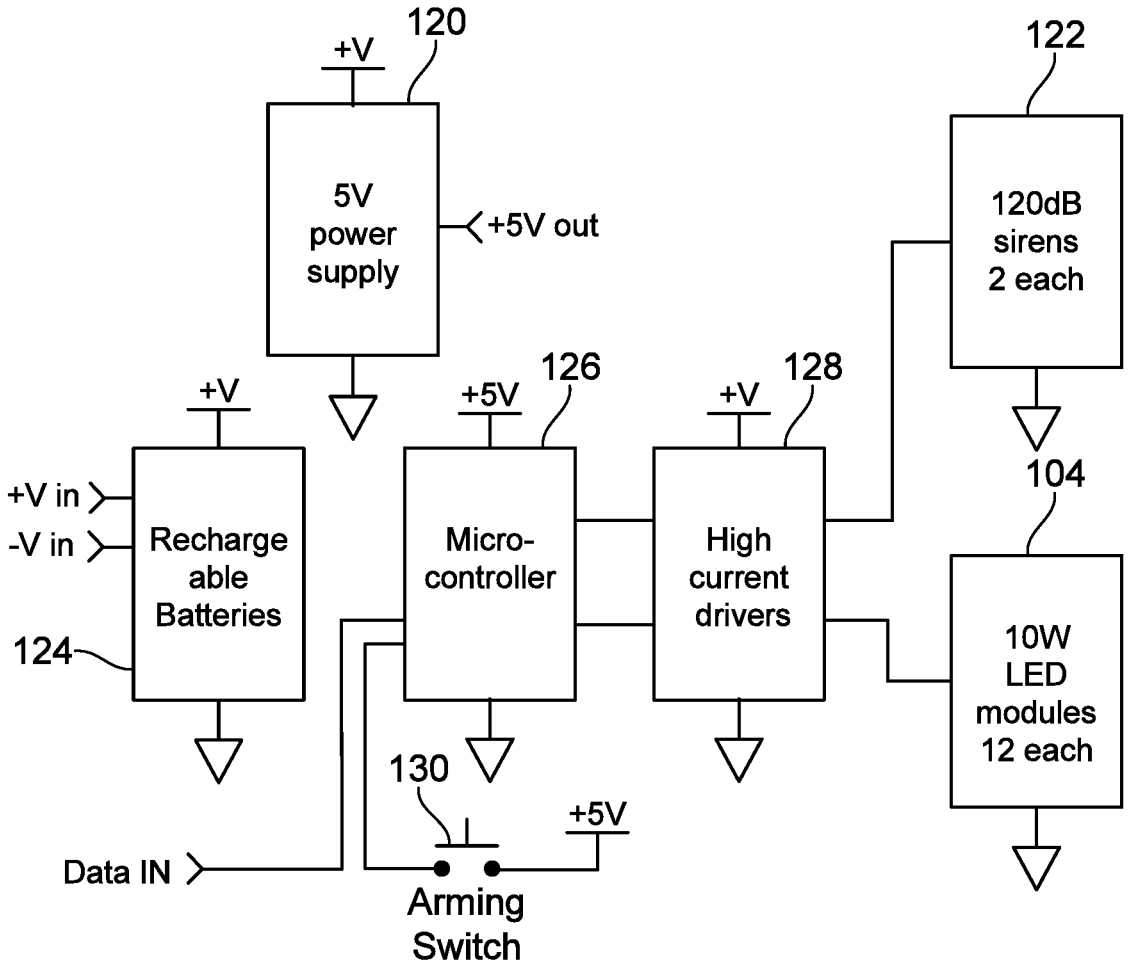
FIG. 10 illustrates a conceptual block diagram of the electronic flashbang device in an embodiment of the present invention.

In one embodiment, electronics components of the device 100 are mounted securely within the housing 102 to protect the device 100 from a drop shock of a minimum of 10' allowing survivability over multiple uses without degradation. Referring to FIG. 10, the electronic components includes a microcontroller 126, power supply unit 120, a high current drivers 128, battery assembly comprising rechargeable batteries 124, LEDs 104, sirens 122 and an arming switch 130. In an embodiment, the microcontroller 126 is an 8-bit RISC, solitary chip microcontroller operating at 16 MHz. The microcontroller 126 comprises onboard chip flash memory, 256 KB flash and 32 KB of RAM, which could be increased using external sources if more memory is required. In one embodiment, the device 100 could be updated and programmed through a lightning connector as well using a laptop computer. In one embodiment, the device 100 utilizes an Arduino microcontroller.

In one embodiment, the power supply unit 120 is a 5-volt power supply chip mounted on a PCB. The power supply unit 120 feeds power to the microcontroller 126. In an embodiment, the high-current drivers 128 converts the output signals of the microcontroller 126 into to a high-power burst of energy. The converted energy is used to drive the LEDs 104 and excite the sirens 122. In one embodiment, the high-power drivers or driver modules 128 could be commercially available driver modules. In one embodiment, the driver modules 128 could be assembled using standard components on the controlling PCB.

In an embodiment, the device 100 comprises rechargeable batteries 124. In one embodiment, the batteries 124 are 9.6V NiMH, 1600 mAHr devices. In an embodiment, the rechargeable batteries 124 are in compact size to pack within the housing 102. In one embodiment, the batteries 124 are rechargeable using the 120V to 12V adapter, cable, and connector. In another embodiment, the batteries 124 supply a minimum of 11,520 mA over two second operation range.

In one embodiment, the LEDs 104 are commercially available white modules capable of illuminating 10 W of light. In another embodiment, each of the 12 LEDs 104 produces 960 lumens of light with a forward voltage of 10.5V and a forward current of 900 mA. The LEDs 104 comprise a capacity to take up to 2,000 mA maximum, over short periods of time, permitting to generate a dazzling light. In one embodiment, the device 100 creates a temporarily blinding pulse of light for around 1 second. In operation, the LEDs 104 use a short pulse of voltage at 900 mA per module. In another embodiment, the wiring is sized to avoid melting of wire insulation. Further, the LED modules 104 are cooled between uses to avoid any heat sinks due to packaging constraints.

In one embodiment, the device 100 comprises a commercially available siren. In another embodiment, the siren 122 comprises a capacity to output 123 dBa at 10 cm or around 120 dBa at 3'on driving with 9.6 VDC at 260 mA. Further, a siren drivers are configured to turn on the sirens 122 on at the same time as the LEDs 104 are initiated. Further, the siren drivers are configured to keep the sirens 122 on for a brief period longer than the LEDs 104 are operated. This allows the maximum disorienting impact of sound to go along with the light pulse. In one embodiment, the sirens 122 are about 2" in diameter and about 2" long to fit up at the ends of the housing 102, output the sound outward through a plurality of holes 108 in the housing 102.

In one embodiment, the printed circuit board (PCB) comprises a standard thickness, double sided FR4 circuit board material, which is populated with surface mounted components. Then, through-hole devices are inserted after the surface mounted assembly, soldering, and cleaning or installed in openings of the housing. Further, connector port 114 are mounted to allow easy cabling to remote components. After assembly, the PCB is protected with a moisture adsorption preventive conformal coating.

The electronic flashbang device 100 according to the present invention, has the following advantages: replaces the pyrotechnics used flashbang; utilizes solid-state electronics to produce high-decibel sounds; produces high intensity LED flash, enables to provide programmable intensity, flash pattern, and other color options; enables to recharge the device 100 for re-use; assures safety to the user and the targets; utilizes fireproof and impact resistant housing 102 cases; and saves time and expenses and cost effective.

Preferred embodiments of this invention are described herein, including the best mode known to the inventors for carrying out the invention. It should be understood that the illustrated embodiments are exemplary only, and should not be taken as limiting the scope of the invention.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein.

The invention claimed is:

1. An electronic flashbang device to control sound and light emissions, comprising: a housing including a first piezo; a first light emitting diode (LED) and a second light emitting diode (LED wherein the first and second light emitting diodes produce at least 7,800 lumens to generate the light emissions.

2. An electronic flashbang device to control sound and light emissions as in claim 1, wherein the housing includes a second piezo siren.

3. An electronic flashbang device to control sound and light emissions as in claim 2, wherein the first and second sirens emit at least 3,000 Hz noise pulse when the electronic flashbang device is energized.

4. An electronic flashbang device to control sound and light emissions as in claim 1, wherein the flashbang device is powered by a battery assembly to produce a loud noise pulse and a bright flash.

5. An electronic flashbang device to control sound and light emissions as in claim 4, wherein the battery assembly includes a rechargeable battery.

6. An electronic flashbang device to control sound and light emissions as in claim 4, wherein the flashbang device is configured to operate repeatedly by utilizing the battery assembly.

7. An electronic flashbang device to control sound and light emissions as in claim 2, wherein the first and second light emitting diode is positioned at an outer surface of the housing.

8. An electronic flashbang device to control sound and light emissions as in claim 1, wherein the housing is a pill-shaped body providing a pill structure to the flashbang device.

9. An electronic flashbang device to control sound and light emissions as in claim 1, wherein the flashbang device includes a safety switch position on the housing for activation of the electronic flashbang device.

10. An electronic flashbang device to control sound and light emissions as in claim 9, wherein the safety switch includes a spring-loaded safety switch.

11. An electronic flashbang device to control sound and light emissions as in claim 1, wherein the housing is a spherical-shaped body providing a spherical structure to the flashbang device.

* * * * *